United States Patent [19]

Kimura et al.

[11] Patent Number: 4,725,821

[45] Date of Patent: Feb. 16, 1988

[54] DEVICE FOR GENERATING AN ALARM SIGNAL

[75] Inventors: Tetsuo Kimura; Akihiro Kobayashi, both of Tokyo, Japan

[73] Assignee: Nittan Company, Ltd., Tokyo, Japan

[21] Appl. No.: 1,978

[22] Filed: Jan. 9, 1987

[30] Foreign Application Priority Data

Mar. 14, 1986 [JP] Japan ..... 61-054915

[51] Int. Cl.[4] ..... G08B 23/00

[52] U.S. Cl. ..... 340/529; 340/530; 340/510; 340/513

[58] Field of Search ..... 340/529, 530, 509–513, 340/500, 506, 526

[56] References Cited

U.S. PATENT DOCUMENTS 4,123,656 10/1978 Kajii ..... 340/529
4,377,808 3/1983 Kao ..... 340/529
4,538,137 8/1985 Kimura ..... 340/530

FOREIGN PATENT DOCUMENTS 45-35862 11/1970 Japan .

*Primary Examiner*—Donnie L. Crosland
*Attorney, Agent, or Firm*—Hill, Van Santen, Steadman & Simpson

[57] ABSTRACT

A device for generating an alarm signal in the event of an abnormality in the environment of a detector includes a pair of signal/power supply lines, a number of detectors for detecting an abnormality, e.g., fire, gas leakage, or burglary, and an alarm receiver including a signal processing circuit for receiving a signal from a detector indicating the presence of an abnormality. The signal process circuit includes a signal storage circuit, and a converting circuit for changing one or a combination of at least two of a polarity, voltage, current, or impedance of a power source if the abnormality persists for a predetermined time. The change in the power source parameter is supplied via the supply lines to a signal holding circuit in the vicinity of the detector. The signal holding circuit is responsive to the changed parameter and changes state, thus providing an indication at the detector that the abnormality has persisted for the predetermined time.

10 Claims, 2 Drawing Figures

DEVICE FOR GENERATING AN ALARM SIGNAL

BACKGROUND OF THE INVENTION

1. Field of the Invention

The present invention relates to a device for generating an alarm signal in the event of a dangerous condition, e.g., fire, gas leakage, burglary, or the like.

2. Description of the Prior Art

Detectors, e.g., fire detectors, often generate an erroneous alarm due to smoke of, e.g., a cigarette, an electrical noise, and the like. In order to prevent this, as described in Japanese patent publication No. 45-35862, upon detection of a fire, the sensor is sometimes reset to allow its re-operation and, thereafter, is set to generate an alarm. A detector of this type, i.e., a so-called storage type fire receiver, has recently received a great deal of attention.

However, since the conventional storage type fire receiver judges an abnormality by detecting the repetitive ON/OFF operations of a switching element, e.g., an SCR, it cannot perform an actual storage operation, in which an abnormality is detected by monitoring that the density of, e.g., smoke caused by a fire has been at an operating level for a predetermined period of time. Therefore, the conventional fire receiver cannot reliably prevent erroneous generation of an alarm.

SUMMARY OF THE INVENTION

It is, therefore, an object of the present invention to provide a device for detecting an abnormality, wherein the device generates an alarm only when an abnormality signal from a detector has been at a given level for a predetermined period of time, thus eliminating erroneous generation of an alarm.

In order to achieve the above object of the present invention, there is provided a device for generating an alarm signal in the event of an abnormality which includes a pair of signal/power supply lines; a plurality of detectors for detecting an abnormality, e.g., fire, gas leakage, or burglary; and an alarm receiver including a signal processing circuit for receiving a signal representing a change in voltage, current, impedance, or the like, upon operation of the detectors, wherein the signal processing circuit comprises a signal storage circuit, and a converting circuit for changing at least one component of a power source supplied through the signal/-voltage supply lines in accordance with an output from the signal storage circuit.

Therefore, with the above arrangement, the detector can be kept in an automatic resettable mode during the storage operation of the receiver. If an abnormality is restored during this interval, the detector can be reset in an initial monitoring mode.

DESCRIPTION OF THE PREFERRED EMBODIMENTS

Figure 1:
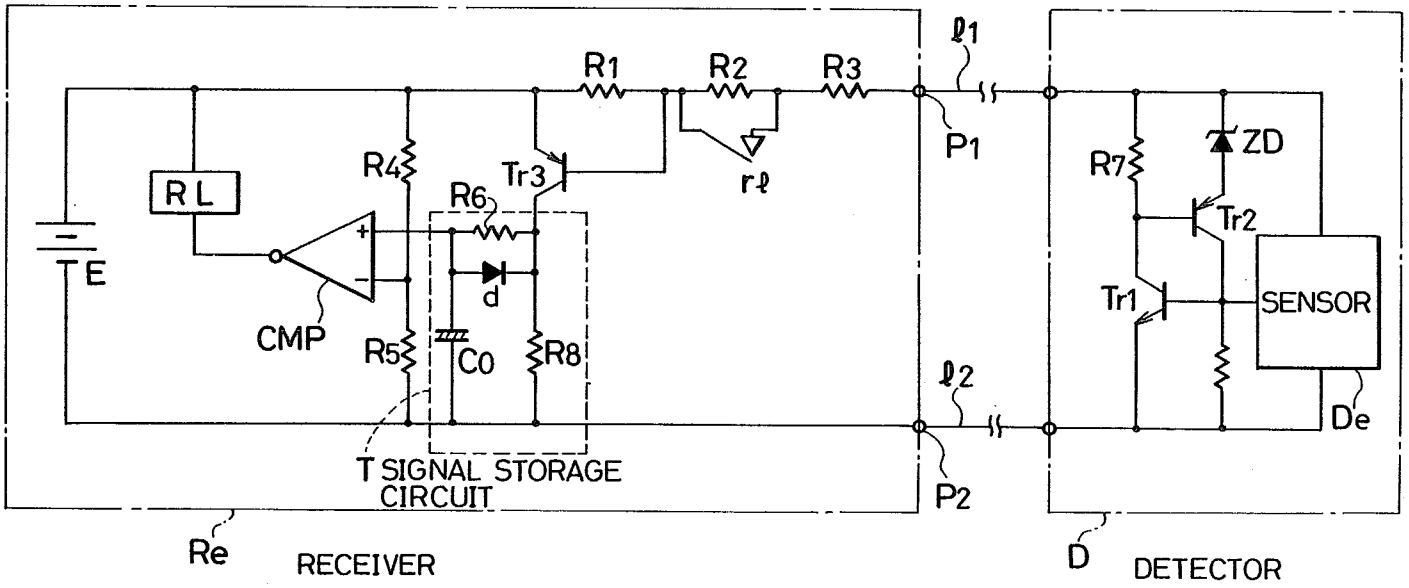
FIG. 1 is a circuit diagram of a device for generating an alarm signal in the event of an abnormality in the surrounding area according to one embodiment of the present invention.
Figure 2:
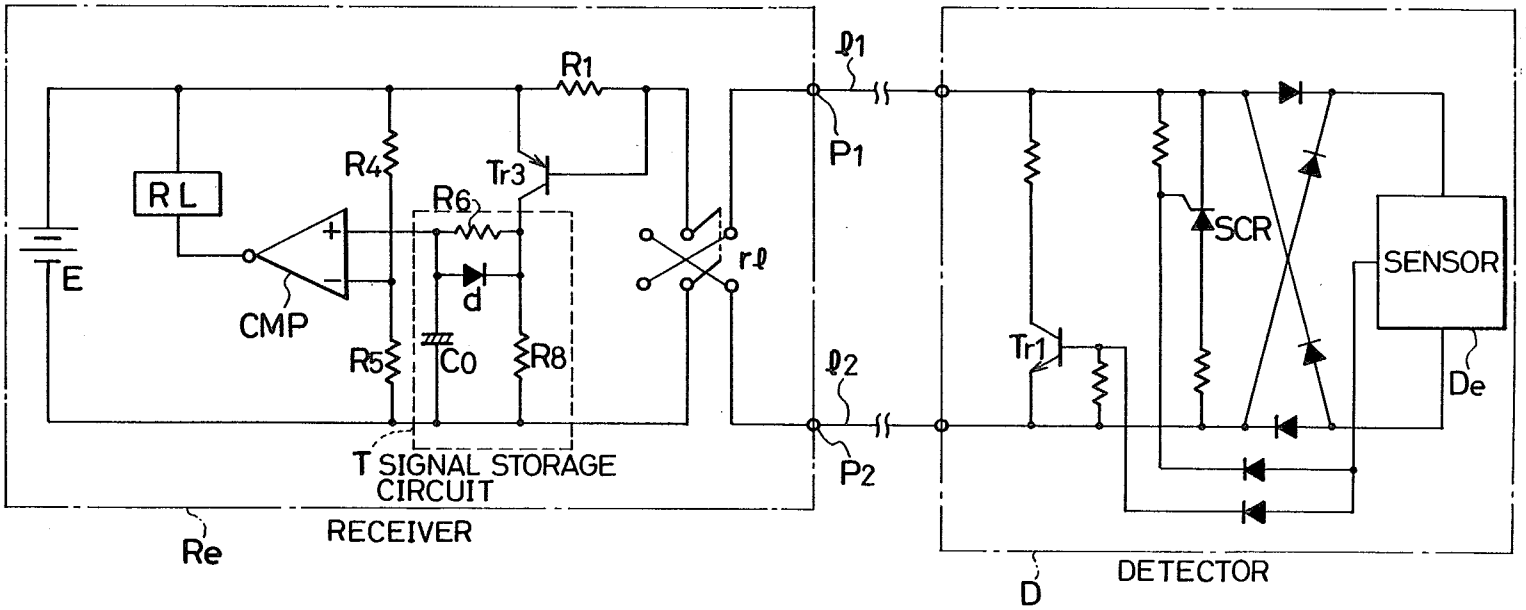
FIG. 2 is a circuit diagram of such a device according to another embodiment of the present invention.

FIGS. 1 and 2 show different embodiments of the alarm device of the present invention, and the same reference numerals therein denote the same parts.

Referring to FIG. 1, a receiver Re includes a power source E; connecting terminals $P_1$ and $P_2$ for a pair of signal/power supply lines $l_1$ and $l_2$ extending from the power source E through resistors $R_1$, $R_2$, and $R_3$; a transistor $Tr_3$, the emitter and base electrodes of which are connected across the resistor $R_1$ and the collector electrode of which is connected to a signal storage circuit T; a comparator CMP, one input of which is connected to the output of the signal storage circuit T and the other input of which is connected to a node between voltage dividing resistors $R_4$ and $R_5$; and a relay RL controlled by the output of the comparator CMP.

A normally open contact rl of the relay RL is connected in parallel across the resistor $R_2$.

The signal storage circuit T includes a time constant circuit consisting of a resistor $R_6$ and a capacitor $C_0$.

The signal/power supply lines $l_1$ and $l_2$ are connected to a detector D. The detector D has a sensor De for detecting a change in the environment such as smoke caused by fire, temperature, gas leakage, and the like, and for generating an output when these factors exceed a predetermined level. The detector D further includes a transistor $Tr_1$ controlled by the output of the sensor De and a transistor $Tr_2$ for positively feeding back its output to the transistor $Tr_1$. The emitter electrode of the positive feedback transistor $Tr_2$ is connected to a voltage regulating (Zener) diode ZD.

With this circuit configuration, when an abnormality is detected by the sensor De of the detector D, the transistor $Tr_1$ is first turned on, and current flows from the power source E of the receiver Re through the resistors $R_1$ to $R_3$ and a resistor $R_7$ connected to the collector electrode of the transistor $Tr_1$. The voltages of the resistor $R_2$ and the Zener diode ZD are predetermined so as not to turn on the transistor $Tr_2$ of the detector D at this time.

When the transistor $Tr_1$ is switched on, the transistor $Tr_3$ of the receiver Re is also turned on, and a voltage is applied to the signal storage circuit T, and the capacitor $C_0$ thereof is charged through the resistor $R_6$. When a charge accumulated on the capacitor $C_0$ reaches a predetermined value, the relay RL is driven in response to the output from the comparator CMP. Upon operation of the relay RL, the normally open contact rl is closed to short-circuit the resistor $R_2$. Therefore, current flowing through the lines $l_1$ and $l_2$ is increased by an amount corresponding to voltage drop across the resistor $R_2$. Therefore, the voltage across the resistor $R_7$ of the detector D exceeds the voltage of the Zener diode ZD, and the transistor $Tr_2$ is operated to hold the operating signal of the detector D therein.

If the output from the sensor De of the detector D extinguishes during the storage operation of the storage circuit T of the receiver Re, the transistor $Tr_1$ is turned off and, at the same time, the transistor $Tr_3$ is also turned off. Therefore, the charge accumulated on the capacitor $C_0$ of the storage circuit T is immediately discharged through a diode d and the resistor $R_6$ to initialize the capacitor $C_0$, thus returning to a normal monitoring mode.

FIG. 2 shows another embodiment of the present invention. Referring to FIG. 2, in a detector D, a transistor $Tr_1$ as a reset type switching element and a switching element SCR as a self-holding type switching element are connected such that their polarities are opposite each other. A diode bridge is interposed between these switching elements and a sensor De for controlling them. In the receiver Re connected to the detector D, the switching contact rl inverts the polarities of lines $l_1$ and $l_2$ upon operation of the relay RL.

With this circuit configuration, in a normal monitoring mode, a power supply voltage is supplied to the detector D while the line $l_1$ is set at a positive potential and the line $l_2$ is set at a negative potential. In this state, when an abnormality signal is generated from the sensor De, the transistor $Tr_1$ is turned on and, at the same time, the transistor $Tr_3$ of the receiver Re is turned on. Thereafter, the relay RL is driven in the same manner as in the embodiment shown in FIG. 1, so that the polarities of the lines $l_1$ and $l_2$ are inverted upon switching operation of the switching contact rl. When the polarities across the terminals of the sensor De are inverted, the switching element SCR is turned on instead of the transistor $Tr_1$. Therefore, the operating signal of the detector D is held therein.

If the output from the sensor De of the detector D extinguishes during the storage operation of the storage circuit T of the receiver Re, the circuit T is reset through the same operation as in FIG. 1.

In the devices shown in FIGS. 1 and 2, the self-holding operation of the detector D is performed by changing the impedance or by inverting the polarity of a power source supplied to the detector D. However, the self-holding operation can be performed by varying a voltage applied to the detector D.

A self-holding signal representing a change in impedance or inversion of polarity from the receiver Re can be used as a drive signal for a fire door, a smoke exhaust device, and the like.

According to the abnormality alarm device of the present invention as described above, a sensor does not perform a self-holding operation during the storage operation of a receiver. When the storage operation of the receiver is completed, a signal based on the storage completion output of the receiver is sent back to the sensor as a signal representing polarity inversion or a change in power source impedance, so that the output of the sensor is self-held. An alarm is generated only after passage of a given period of a continuous abnormality signal from the sensor is confirmed. Therefore, erroneous generation of an alarm can be minimized. In addition, an alarm from the receiver can be obtained at the sensor side as a response signal through a small number of lines. Moreover, after generation of the alarm, the output of the sensor can be self-held to be utilized as a drive signal for an operation indication lamp or a smoke exhaust device.

Although modifications and changes may be suggested by those skilled in the art it is the intention of the inventor to embody within the patent warranted hereon all changes and modifications as reasonably and properly come within the scope of their contribution to the art.

We claim as our invention:

1. A system for use in generating an alarm signal comprising:

at least one detector circuit including a sensor for detecting an abnormality in a selected volume in which said sensor is disposed, and a signal holding circuit; and a receiver circuit connected to said sensor and to said signal holding circuit by supply lines, said receiver circuit having a power source connected to said supply lines, means for storing a signal indicating an abnormality from said sensor, and means for changing an output parameter of said power source if said abnormality signal persists in said means for storing a signal for a predetermined time, said signal holding circuit being responsive to the changed output parameter to change the state of a component in said signal holding circuit and thus maintain a condition at said detector indicating said abnormality signal has persisted for said predetermined time.

2. A system as claimed in claim 1, wherein said means for storing a signal comprises:

a capacitor connected to a negative terminal of said power source and to an output terminal of said means for storing a signal;

a first resistor connected to said negative terminal of said power source and to an input terminal of said means for storing a signal;

a second resistor connected between said input and output terminals; and a diode having a cathode connected to said input terminal and an anode connected to said output terminal.

3. A system as claimed in claim 1, wherein said means for changing an output parameter of said power source comprises:

a relay connected to an output of said means for storing a signal and to a positive terminal of said power source;

a resistor connected in one of said supply lines which is connected to said positive terminal of said power source, said relay having a contact connected across said resistor, said relay operating upon a signal from said output of said means for storing a signal after said predetermined time to shortcircuit said resistor thereby decreasing the impedance of said supply line connected to said positive terminal.

4. A system as claimed in claim 3, further comprising a comparator connected between said output of said means for storing a signal and said relay for triggering operation of said relay when the signal at said output of said means for storing a signal reaches a threshold level.

5. A system as claimed in claim 1, wherein said signal holding circuit comprises for each detector circuit:

a resistor connected to an input terminal of said detector circuit;

a first transistor having an emitter connected to an output terminal of said detector circuit and a collector connected to an opposite end of said resistor;

a Zener diode having a cathode connected to said input terminal; and a second transistor having a collector connected to the anode of said Zener diode, an emitter connected to said output terminal and to the base of said first transistor, and a base connected to a node between said resistor and said first transistor, said resistor and said Zener diode being dimensioned such that upon said change in said output parameter of said power source the voltage across said resistor exceeds the voltage across said Zener diode and said second transistor is turned on and said first transistor is turned off thus maintaining said condition indicating said abnormality signal has persisted for said predetermined time, and said first transistor being turned off for resetting said means for storing a signal when said sensor no longer generates an output signal.

6. A system as claimed in claim 1, wherein said means for changing an output parameter of said power source comprises:

a relay connected to an output of said means for storing a signal, said relay having a switching contact connected to said supply lines for switching the polarities thereof upon triggering of said relay by a signal from said means for storing a signal after said predetermined time.

7. A system as claimed in claim 6 further comprising a comparator connected between said output of said means for storing a signal and said relay for triggering said relay when said signal from said output of said means for storing a signal exceeds a threshold value.

8. A system as claimed in claim 6, wherein said signal holding cirucit comprises for each detector circuit:

a first transistor having a collector connected to an input terminal of said detector circuit and an emitter connected to an output terminal of said detector circuit;

a switching element which maintains a change of state upon being switched to said change of state, said switching element being connected reverse-biased across said sensor; and a diode bridge connected across said sensor for controlling said first transistor and said switching element, said first transistor being responsive to said changed output parameter of said power source so as to turn off upon the occurrence of said changed parameter and said switching element being responsive to said changed parameter so as to be turned on upon the occurrence of said changed parameter thus maintaining said condition indicating said abnormality signal has persisted for said predetermined time, said first transistor being turned on and said switching element being turned off when said sensor no longer generates a signal, for resetting said means for storing a signal.

9. A system for use in generating an alarm signal comprising:

at least one detector circuit including a sensor for detecting an abnormality in a selected volume in which said sensor is disposed;

a receiver circuit connected to said sensor by two supply lines respectively connected to positive and negative terminals of a power source in said receiver circuit;

a signal storage circuit in said receiver circuit having a capacitor connected to said negative terminal of said power source and to an output terminal of said signal storage circuit, a first resistor connected to said negative terminal of said power source and to an input terminal of said signal storage circuit connected to said sensor, a second resistor connected between said input and output terminals of said signal storage circuit, and a diode having a cathode connected to said input terminal of said signal storage circuit and an anode connected to said output terminal of said signal storage circuit;

a third resistor connected in the power supply line connected to said positive terminal of said power source;

a relay having a contact operable for bridging said third resistor;

a comparator having an input connected to said output terminal of said signal storage circuit for operating said relay to bridge said third resistor when the voltage across said capacitor exceeds a predetermined value thereby changing the impedance of said supply line connected to said positive terminal; and a signal holding circuit in said detector circuit having a fourth resistor connected to the supply line connected to said positive terminal of said power source, a first transistor having an emitter connected to the supply line connected to said negative terminal of said power source, a collector connected to the other side of said fourth resistor, and a base connected to an output of said sensor, a Zener diode having a cathode connected to said supply line connected to said positive terminal of said power source, and a second transistor having a collector connected to the anode of said Zener diode, an emitter connected to said supply line connected to said negative terminal of said power source, and a base connected between said fourth resistor and said collector of said first transistor, whereby generation of a signal from said sensor indicating the presence of said abnormality charges said capacitor until said comparator threshold is reached, thereby triggering said relay to bridge said third resistor and change the impedance of said supply line connected to said positive terminal of said power source, causing the voltage across said fourth resistor to exceed the voltage across said Zener diode and turnign on said second transistor and turning off said first transistor so as to maintain a condition in said detector circuit indicating that said abnormality signal has persisted for a predetermined time necessary to charge said capacitor to said threshold value, and said sensor turning off said first transistor when said abnormality is no longer present thereby discharging said capacitor.

10. A system for use in generating an alarm signal comprising:

at least one detector circuit including a sensor for detecting an abnormality in a selected volume in which said sensor is disposed;

a receiver circuit connected to said sensor by two supply lines respectively connected to positive and negative terminals of a power source in said receiver circuit;

a signal storage circuit in said receiver circuit having a capacitor connected to said negative terminal of said power source and to an output terminal of said signal storage circuit, a first resistor connected to said negative terminal of said power source and to an input terminal of said signal storage circuit connected to said sensor, a second resistor connected between said input and output terminals of said signal storage circuit, and a diode having a cathode connected to said input terminal of said signal storage circuit and an anode connected to said output terminal of said signal storage circuit;

a relay having a contact connected to said supply lines operable for switching the polarities thereof;

a comparator having an input connected to said output terminal of said signal storage circuit and having an output connected to said relay for operating said relay to switch said polarities of said supply line when the output of said signal storage circuit reaches a threshold value; and a signal holding circuit in said detector circuit including a first transistor having a collector and an emitter connected across said supply lines and a base connected to a control output of said sensor, a switching element which maintains a change of state when switched connected across said supply line and having a trigger electrode connected to said control output of said sensor, and a diode bridge connected across said supply lines and across said sensor for controlling said first transistor and said switching element, whereby upon operation of said relay to switch the polarities of said supply lines, said first transistor is turned off and said switching element is turned on thus maintaining a condition at said detector circuit indicating said abnormality signal has persisted for a perdetermined time necessary to charge said capacitor to said threshold value, and said control output of said sensor providing a signal for turning said first transistor on and said switching element off upon the absence of said abnormality signal for discharging said capacitor.

* * * * *